United States Patent [19]

Coulon et al.

[11] Patent Number: 4,689,095

[45] Date of Patent: Aug. 25, 1987

[54] STEEL FOR MANUFACTURING LARGE FORGED PARTS

[75] Inventors: André Coulon, Bessoncourt; Chantal Loier, Belfort; Jean-Pierre Badeau, Le Breuil, all of France

[73] Assignee: Alsthom-Atlantique, Paris, France

[21] Appl. No.: 741,334

[22] Filed: Jun. 5, 1985

[30] Foreign Application Priority Data

Jun. 5, 1984 [FR] France ..... 84 08785

[51] Int. Cl.[4] ..... C22C 38/22

[52] U.S. Cl. ..... 148/325; 420/69

[58] Field of Search ..... 75/128 G, 128 V, 128 N, 75/128 W; 148/37, 325; 420/69

[56] References Cited

U.S. PATENT DOCUMENTS 3,767,390 10/1973 Hahn ..... 75/128 G
4,414,024 11/1983 Siga et al. ..... 148/37
4,477,280 10/1984 Shiga et al. ..... 148/37

FOREIGN PATENT DOCUMENTS 833240 4/1960 United Kingdom .

*Primary Examiner*—L. Dewayne Rutledge
*Assistant Examiner*—Deborah Yee
*Attorney, Agent, or Firm*—Sughrue, Mion, Zinn, Macpeak & Seas

[57] ABSTRACT

The present invention provides a steel containing, by mass:

from 0.16% to 0.22% carbon (C)
less than 0.3% silicon (Si)
less than 0.5% manganese (Mn)
from 0.6% to 0.9% nickel (Ni)
from 10.7% to 12.3% chromium (Cr)
from 0.8% to 1.1% molybdenum (Mo)
from 0.2% to 0.35% vanadium (V)
from 0.07% to 0.20% niobium (Nb)
from 0.05% to 0.11% nitrogen ($N_2$)
less than 0.008% boron (B)

and not more than the following residual percentages by mass:

0.020% sulfur, 0.020% phosphorous, 0.025% cobalt, 0.010% aluminum, 0.02% titanium, 0.02% tin, 0.10% copper, 0.015% tungsten, 0.020% arsenic, and 0.0025% antimony;

the remainder of the alloy being iron; said steel having a nickel equivalent calculated using the formula:

$$Ni\ eq = 30C + 0.5Mn + 2Ni + 25N_2 + 40B,$$

lying in the range 9 to 10.2;

and a chromium equivalent calculated using the formula:

$$Cr\ eq = Cr + 2Si + 1.5Mo + 5V + 1.75Nb$$

lying in the range 14.5 to 15.5;

the ratio between the chromium equivalent and the nickel equivalent lying in the range 1.49 to 1.65.

5 Claims, 2 Drawing Figures

STEEL FOR MANUFACTURING LARGE FORGED PARTS

The present invention relates to a steel for manufacturing large forged parts, and in particular turbine rotors.

BACKGROUND OF THE INVENTION

Conventional turbine rotors made of Cr-Mo-V steel enable steam temperatures of about 550° C. to be used.

In order to use steam at higher temperatures while retaining good mechanical properties, steels which are highly alloyed with chromium have been used, as described, for example, in published French Pat. No. 1 407 452.

Steel in accordance with the invention improves the mechanical properties both at ambient temperature and when hot, and may be used with steam at 600° C.

SUMMARY OF THE INVENTION

The present invention provides a steel consisting essentially of, by mass:

from 0.16% to 0.22% carbon (C)
less than 0.3% silicon (Si)
less than 0.5% manganese (Mn)
from 0.6% to 0.9% nickel (Ni)
from 10.7% to 12.3% chromium (Cr)
from 0.8% to 1.1% molybdenum (Mo)
from 0.2% to 0.35% vanadium (V)
from 0.07% to 0.20% niobium (Nb)
from 0.05% to 0.11% nitrogen ($N_2$)
less than 0.008% boron (B)

and not more than the following residual percentages by mass:

0.020% sulfur, 0.020% phosphorous, 0.025% cobalt, 0.010% aluminum, 0.02% titanium, 0.02% tin, 0.10% copper, 0.015% tungsten, 0.020% arsenic, and 0.0025% antimony;

the remainder of the alloy being iron; said steel having a nickel equivalent calculated using the formula:

$$\text{Ni eq} = 30C + 0.5Mn + 2Ni + 25N_2 + 40B,$$

lying in the range 9 to 10.2;

and a chromium equivalent calculated using the formula:

$$\text{Cr eq} = Cr + 2Si + 1.5Mo + 5V + 1.75Nb$$

lying in the range 14.5 to 15.5;

the ratio between the chromium equivalent and the nickel equivalent lying in the range 1.49 to 1.65.

In order to obtain good mechanical properties, forged parts made of steel in accordance with the invention are subjected to heat treatment comprising the following steps:

the part is homogenized at a temperature lying between 1130° C. and 1170° C. for sufficient time to complete putting into solution, followed by slow cooling in the oven;

austenitization between 1050° C. and 1130° C. followed by quenching down to a temperature of 250° C.; and tempering to obtain the final characteristics.

In accordance with the preferred implementation, the tempering comprises the following steps:

a first temperature rise to a temperature $\theta_1$ lying between 540° C. and 600° C., and preferably 560° C., and maintaining said temperature for a period t of not less than 25 h;

slow cooling to ambient temperature;

a second temperature rise up to a temperature $\theta_2$ lying between 650° C. and 710° C., and preferable equal to 685° C., for a period t not less than 25 h;

slow cooling down to ambient temperature; and stabilization treatment at a temperature $\theta_3 = \theta_2 - \theta_0$ for a period of time not less than 25 h with $\theta_0$ lying the range 30° C. to 50° C.

BRIEF DESCRIPTION OF THE DRAWING

The present invention will be better understood from the following description which is given with reference to the accompanying drawing, in which.

MORE DETAILED DESCRIPTION

Figure 1:
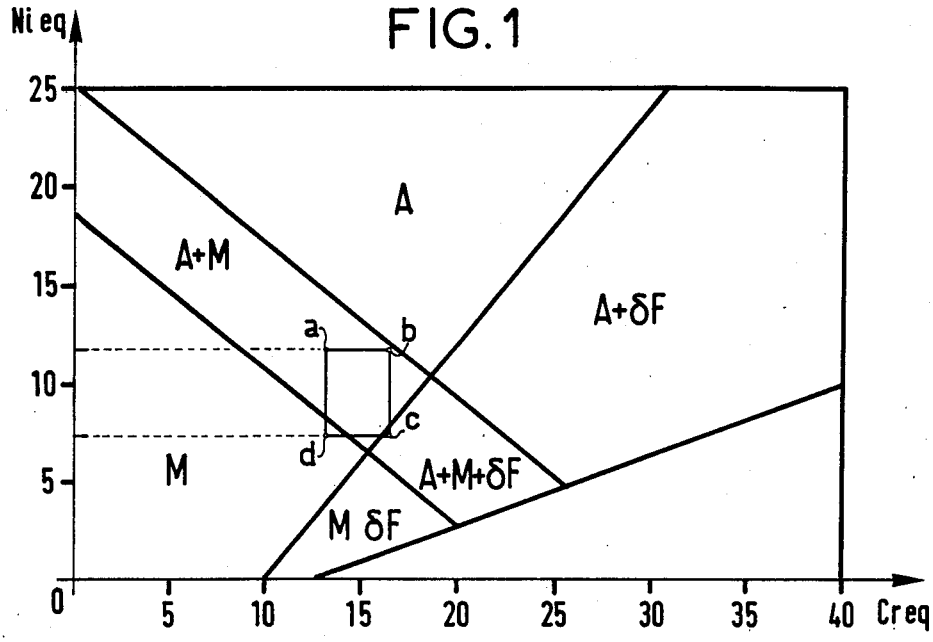
FIG. 1 is a diagram with a Cr eq axis and an orthogonal Ni eq axis showing the region occupied by steels having a composition in accordance with the invention.

The invention relates to a highly alloyed steel composition for forging large parts in which the addition of niobium (which is conventional for a steel having high resistance to creep at high temperatures) is limited, as is the addition of nitrogen; and the mix of additive elements serves to reach an equilibrium in which the presence of residual ferrite in the structure is avoided.

It is well known that 12% chromium steels (i.e. having 10% to 14% chromium) and including large additions of niobium (0.2% to 0.5%) in addition to vanadium have good creep properties. However, the presence of too much niobium carbide in the core of large forged parts may lead to inadequate ductility characteristics in directions perpendicular to the rolling direction. The need to reduce the niobium content may have a corresponding effect on the high temperature properties, which is not desirable. It is therefore important to limit the combined content of niobium and of nitrogen to the unavoidable minimum in order to obtain acceptable ductility in all directions while still seeking to put the carbo-nitrides formed during heat treatment completely into solution. The choice of austenitization temperature and the time for which it is maintained are adjusted (for a given diameter of forged part) to the exact niobium content of the steel composition in order to make full use of said additive.

Furthermore, an "unbalanced" composition may lead to excess ferrite in the structure of large parts. This may be excluded by carefully adjusting the proportion of additive elements. A fairly accurate method of performing this adjustment is the "chromium and nickel equivalent" method which attributes coefficients to each element representative of the element's suitability for forming ferrite (alphagenous elements) and for forming austenite (gammagenous elements). Alphagenous elements include Si, Cr, Mo, W, V, Nb, Ti, and Al. Gammagenous elements include C, Mn, Ni, Co and Cu.

The existing literature provides a selection of formulas for calculating chromium and nickel equivalents. The work of Schneider or that of Rickett, White, Walton and Butler may be mentioned. The following table gives an indication of the ferrite or austenite forming aptitude coefficients for each additive element.

| Gammagenous elements γeq (austenite) | | Alphagenous elements αeq (ferrite) | |
|---|---|---|---|
| C | −30 | Si | +2 |
| Mn | −0.5 | Cr | +1 |
| Ni | −2 | Mo | +1.5 |
| $N_2$ | −25 | V | +5 |
| Co | −2 | Nb | +1.75 |
| Cu | −0.5 | W | +0.75 |
| B | −40 | Ti | +1.5 |
| | | Al | +5.5 |

Estimates are calculated using the following equations in which the symbols correspond to the mass of the element in the steel:

$$\text{Nickel equivalent} = 30C + 0.5Mn + 2Ni + 25N_2 + 40B$$

$$\text{Chromium equivalent} = Cr + 2Si + 1.5Mo + 5V + 1.75Nb$$

An alloy composition in accordance with the invention has, on the basis of the above, a chromium equivalent in the range 14.5 to 15.5 and more advantageously in the range 14.7 to 15.3, and a nickel equivalent in the range 9 to 10.2, with the optimum ratio between the chromium equivalent and the nickel equivalent lying in the range 1.49 to 1.65.

FIG. 1 is a diagram in which chromium equivalent is plotted along the X-axis and nickel equivalent is plotted up the Y-axis. The final structures obtained are shown in FIG. 1, with the straight lines indicating, in conventional manner, the passage from one structure to another (where A is austenite, M is martensite, and δF is delta-ferrite). The rectangle abcd represents the zone whose chemical analysis is limited by the extremes of the compositions used ($7.25 < Ni\ eq < 11.72$, and $13.12 < Cr\ eq < 16.65$).

The optimum is obtained inside a small rectangle cfgh (see FIG. 2) corresponding to $9 < Ni\ eq < 10.2$ and $14.5 < Cr\ eq < 15.5$, and more particularly in the zone ifjkhl of the this small rectangle lying between two straight lines D and D′ given by the ratio of Cr eq/Ni eq being equal to 1.49 to 1.65.

Residual austenite can be found above the line D. Residual ferrite can be found below the line D′. In the zone ifjkhl martensite is to be found without any residual austenite and/or ferrite.

Figure 2:
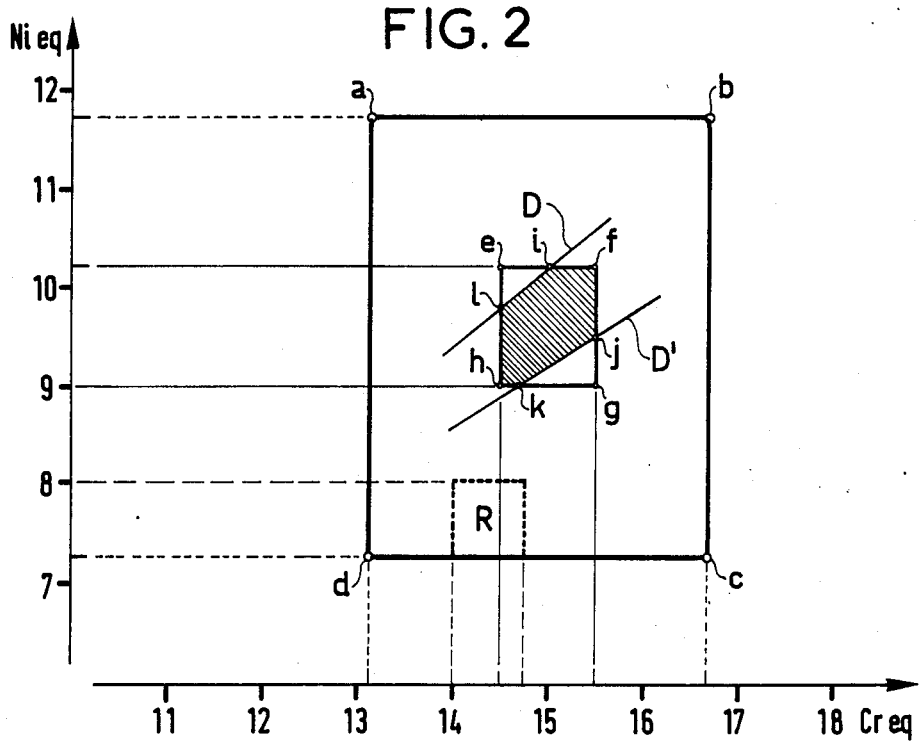
FIG. 2 shows a portion of the FIG. 1 diagram to a larger scale.

FIG. 2 also indicates in dashed lines a rectangle R giving the limits of the preferred compositions as described in French Pat. No. 1 407 452.

To obtain the desired characteristics at ambient and at high temperatures, a forged part made of the alloy in accordance with the invention is subjected to a particular heat treatment. The following description concerns a forged part having a diameter of 1400 mm and a weight of about 30 metric tons.

The part is homogenized at a temperature in the range 1130° C. to 1170° C. for a period of time which is sufficient to complete putting into solution, and is followed by cooling in the oven to about 700° C. Austenitization between 1050° C. and 1130° C. is followed by quenching (in oil, water droplets, or puffed air) in such a manner as to ensure that the speed of cooling in the core of the part is not less than 40° $C.h^{-1}$: a pearlite transformation which would take place at slower cooling speeds must be avoided. The temperature of the part is reduced to less than 250° C., at which temperature the martensite transformation is complete.

Subsequently the part is tempered to give it its final characteristics. The tempering may take place in several stages: a first temperature rise to about 560° C. (540° C. to 600° C.) maintained for at least 25 hours (and up to 48 hours). After slow cooling to ambient temperature, a second tempering operation is performed to complete the transformation of any austenite which may remain into martensite and to give the part its desired characteristics. This treatment takes place at a temperature lying between 650° C. and 710° C. (with the optimum being about 685° C.) for a similar period of time to the first tempering operation. After cooling in the oven to ambient temperature, a relaxation treatment is performed at a temperature which is about 30° C. less than the temperature of the second tempering operation and this temperature is maintained for a period of 35 to 48 hours.

Numerous tests have been performed on the following compositions:

| | composition | | | |
|---|---|---|---|---|
| elements | 1 | 2 | 3 | 4 |
| C % | 0.185 | 0.191 | 0.19 | 0.193 |
| Ni % | 0.75 | 0.78 | 0.80 | 0.79 |
| Cr % | 11.5 | 11.3 | 11.4 | 11.5 |
| Mo % | 0.90 | 0.95 | 0.98 | 0.95 |
| V % | 0.32 | 0.30 | 0.29 | 0.31 |
| Nb % | 0.13 | 0.135 | 0.198 | 0.201 |
| $N_2$ % | 0.072 | 0.098 | 0.070 | 0.098 |
| B % | 0.0035 | 0.0040 | 0.0032 | 0.0036 |
| trace elements | less than the following limits: 0.020% sulfur, 0.020% phosphorous 0.025% cobalt, 0.010% aluminum 0.02% titanium, 0.02% tin 0.10% copper, 0.015% tungsten 0.020% arsenic, 0.0025% antimony | | | |
| iron | remainder | | | |

The following heat treatments were performed:

| | |
|---|---|
| Homogenization | 1150° C. |
| Austenitization | 1080° C. |
| Water droplet quench | 560° C. and 685° C. |
| Tempering at | |

These steels had the following instantaneous breaking stresses at 550° C.:

| | |
|---|---|
| minimum UTS 535 MPa | Minimum 0.002 stress 460 MPa |
| maximum UTS 600 MPa | Maximum 0.002 stress 530 MPa |

The creep tests using Larson and Miller extrapolation at 550° C. (parameter TK (25+log t) $10^{-3}$);

$10^4$ h: 282 MPa±28;

$10^5$ h: 185 MPa±14.

5d elongation at breakage between 13.5% to 21%.

Necking at breakage in the range 41% to 70%.

What is claimed is:

1. A steel for manufacture of large diameter, high temperature steam turbine rotors for operation at 500° C. to 600° C. and having rotor diameters at least equal to 1400 mm, said steel being annealed at cooling rates no lower than 80° C./h and being of totally stabilized martensite, said steel consisting essentially of, by mass:

from 0.16% to 0.22% carbon (C)

less than 0.3% silicon (si)

less than 0.5% manganese (Mn)

from 0.6% to 0.9% nickel (Ni)

from 10.7% to 12.3% chromium (Cr)
from 0.8% to 1.1% molybdenum (Mo)
from 0.2% to 0.35% vanadium (V)
from 0.07% to 0.20% niobium (Nb)
from 0.05% to 0.11% nitrogen ($N_2$)
less than 0.008% boron (B)
and not more than the following residual percentages by mass:
0.020% sulfur, 0.020% phosphorous, 0.025% cobalt, 0.010% aluminum, 0.02% titanium, 0.02% tin, 0.10% copper, 0.015% tungsten, 0.020% arsenic, and 0.0025% antimony;
the remainder of the alloy being iron; said steel having a nickel equivalent calculated using the formula:

$$\text{Ni eq} = 30C + 0.5Mn + 2Ni + 25N_2 + 40B,$$

lying in the range 9 to 10.2;
and a chromium equivalent calculated using the formula:

$$\text{Cr eq} = Cr + 2Si + 1.5Mo + 5V + 1.75Nb$$

lying in the range 14.5 to 15.5;
the ratio between the chromium equivalent and the nickel equivalent lying in the range 1.49 to 1.65 and wherein said steel has a creep resistance on the order of the following;
$10^4$ h: 282 MPa+28
$10^5$ h: 185 MPa+14

2. A steel according to claim 1, wherein the chromium equivalent is in the range 14.7 to 15.3.

3. A steel according to claim 1, containing less than 0.1% by weight of silicon.

4. A steel according to claim 1, containing less than 0.3% of manganese.

5. A steel according to claim 1, containing 0.005% boron.

* * * * *